US006135821A

United States Patent [19]

Liu

[11] Patent Number: 6,135,821

[45] Date of Patent: Oct. 24, 2000

[54] ADAPTER STRUCTURE AND METHOD FOR FORMING SAME

[75] Inventor: Danny Liu, Taipei Hsien, Taiwan

[73] Assignee: Dan-Chief Enterprise Co., Ltd., Taipei Hsien, Taiwan

[21] Appl. No.: 09/377,825

[22] Filed: Aug. 20, 1999

[51] Int. Cl.[7] ..... H01R 24/00

[52] U.S. Cl. ..... 439/676; 439/76.1; 439/701; 439/404; 439/752

[58] Field of Search ..... 439/676, 404, 439/76.1, 417, 405, 83, 701, 752

[56] References Cited

U.S. PATENT DOCUMENTS

| | | | |
|---|---|---|---|
| 5,403,200 | 4/1995 | Chen | 439/676 |
| 5,503,572 | 4/1996 | White et al. | 439/676 |
| 5,695,361 | 12/1997 | Elisei | 439/404 |
| 5,905,637 | 5/1999 | Su | 439/676 |
| 5,947,752 | 9/1999 | Wu | 439/676 |
| 5,957,730 | 9/1999 | Wang | 439/676 |
| 5,980,325 | 11/1999 | Horchler | 439/733.1 |

*Primary Examiner*—Paula Bradley
*Assistant Examiner*—Tho D. Ta
*Attorney, Agent, or Firm*—Arent Fox Kintner Plotkin & Kahn, PLLC

[57] ABSTRACT

An adapter structure for providing an interface between an external wire and a circuit board includes an inner unit, an outer unit separable from the inner unit, and a first set of terminals mounted between the inner unit and the outer unit, wherein the terminals respectively include feet for being electrically connected with the circuit board. The adapter structure further includes a second set of terminals mounted between the inner unit and the outer unit, wherein the second terminals respectively include feet for being electrically connected with the circuit board. The first and second sets of terminals are respectively mounted at two opposite sides of the inner unit. The inner unit and the outer unit form a mounting which includes plural positioning elements respectively having plural protrusions and plural grains for positioning the first and the second sets of terminals respectively having plural slots and plural holes thereon.

25 Claims, 15 Drawing Sheets

ADAPTER STRUCTURE AND METHOD FOR FORMING SAME

FIELD OF THE INVENTION

The present invention relates to an adapter structure and more particularly to an improved adapter structure for an adapter socket to be applied in telecommunication networks or computer networks, among others.

BACKGROUND OF THE INVENTION

The adapter is widely used in a general network socket. It has a set of terminals which are generally formed into an Insulation Displacement Connector (hereinafter abbreviated as IDC). The terminals are electrically connected with an external wire by piercing through its insulation, and then a network plug is connected with the network socket.

Referring to FIGS. 1 & 2, there is shown a prior network socket having an inner unit 11 and an outer unit 15. A set of terminals 13 are respectively integrally formed with a set of spring wires 12. Inner unit 11 has a set of bifurcate protrusions 14 to mount thereon the set of terminals 13. And terminals 13 would be moved along grooves 16 of outer unit 15 to form an adapter structure. A molded receptacle 17 is combined with the adapter structure to form a network socket. It is necessary to make respectively two metal strands in convex and concave manners and get them close to each other to form crossed stands 121 in accordance with the code of Category 5 of high frequency transmission in FIG. 2.

It is not cheap to make the adapter structure shown in FIG. 1, and more especially to integrally form terminals 13 and spring wires 12. In addition, the adapter structure cannot meet the requirements of the code of Category 6 and its inner unit 11 must be combined tightly with outer unit 15 by gluing for reinforcing their combination. Apparently, it would further make the cost up.

In FIG. 3 of the drawings, the other prior network socket has a molded receptacle 24 and an adapter which includes an upper mounting 21, a printed circuit board 22 and a lower mounting 23. Upper mounting 21 includes eight grooves 211 and protrusions 212, 213. There are eight terminals 221 which are soldered on printed circuit board 22 and inserted into eight grooves 211. Two holes 222, 223 on printed ciucuit board 22 are penetrated by protrusions 212, 213 which are tightly engaged in two holes 231, 232 on lower mounting 23 for forming the adapter structure. Finally, its front segment 224 is inserted into an opening 242 of molded receptacle 24 and a protrusion 233 of lower mounting 23 is simultaneously engaged in a slit 241 of molded receptacle 24.

Eight terminals 221 are respectively put on printed circuit board 22 for being soldered by a soldering stove, and then inserted into upper mounting 21. It is inconvenient to put eight terminals 221 respectively or put upper mounting 21 as eight terminals might be slant. If printed circuit board 22 with eight terminals 221 cannot be inserted into upper mounting 21, they will become a waste material and all efforts are in vain. A gluing process (e.g. supersonic wave gluing process) is necessary after protrusions 212, 213 are inserted into holes 231, 232. It would thus cause the cost up. Furthermore, it is not economic in that the adapter structure in FIG. 3 can only be used for a network socket.

FIG. 4 shows another prior network socket having two IDCs 32. There is a printed circuit board 34 combined with two IDCs 32. It is troublesome to insert a first set of terminals 31 one by one into plural holes 321 of an IDC 32 by a tool (not shown) in FIG. 5. Terminals 31 have feet 311 and will penetrate holes 321 as shown in FIG. 4, and then feet 311 are soldered on eight holes 35. The cost would be increased in that two IDCs 32 must be soldered one afer another. And in FIG. 6, two IDCs 32 respectively being electrically connected with circuit board 34 are not secured thereon firmly enough. An I-shape piece 37 is mounted between two IDCs 32 on circuit board 34 in FIG. 7, it can help IDCs 32 to resist against the external forces F1, F2.

For assembling circuit board 34 with socket body 40, spring wires 342 are inserted into plural slits 402 and protrusions 341 are engaged with grooves 401 in FIG. 6, but piece 37 cannot fix circuit board 34 on socket body 40 in FIG. 7. Piece 37 has a front segment 371 inserted between socket body 40 and IDCs 32 and a rear segment 372 connected with IDCs 32, wherein front segment 371 and rear segment 372 are closely connected with IDCs 32. Though piece 37 has two bulges 38 engaged with the lower edge 341 of circuit board 34, it does not engage with socket body 40. The disadvantages of such socket structure are as follows:

a) it is not convenient to use the tool for inserting terminals 31 into holes 321;
b) two IDCs 32 cannot be concurrently put on circuit board 34 as they are to be respectively soldered;
c) IDCs 32 are not stable enough on circuit board 34;
d) piece 37 is not firmly engaged with socket body 40; and
e) the assembling strength of piece 37 with IDCs 32 is not enough to conquer external forces F1, F2, and IDCs by themselves 32 cannot resist against forces F1, F2.

It is therefore tried by the applicant to overcome the above problems encountered by the prior art.

SUMMARY OF THE INVENTION

It is therefore an object of the present invention to reduce the cost of the adapter.

It is another object of the present invention to provide an adapter structure easy to assemble.

It is further an object of the present invention to efficiently fasten the adapter structure on the socket body.

It is additional an object of the present invention to provide a network socket of a strengthened adapter structure.

It is still an object of the present invention to use the adapter structure as a connector for connecting two external wires.

According to the present invention, an adapter structure for providing an interface between an external wire and a circuit board, comprising an inner unit, an outer unit separable from the inner unit, and a first set of terminals mounted between the inner unit and the outer unit, wherein the terminals respectively include feet for being electrically connected with the circuit board.

Preferably the adapter structure further includes a second set of terminals mounted between the inner unit and the outer unit, wherein the second terminals respectively include feet for being electrically connected with the circuit board.

Preferably the first and second sets of terminals are respectively mounted at two opposite sides of the inner unit.

Certainly, the inner unit and the outer unit can form a mounting which includes plural positioning elements respectively having plural protrusions and plural grains for positioning the first and second sets of terminals respectively having plural slots and plural holes thereon.

Certainly, the outer unit can have a first set of grooves respectively receiving threrein the first set of terminals and the inner unit has a first set of grooves respectively receiving threrein a first set of rails of the outer unit.

Preferably the outer unit has a first set of holes respectively penetrated by the feet of the terminals for connection of the first set of terminals and the circuit board.

Preferably the inner unit includes a third protrusion to fix the outer unit having a third opening thereon.

Certainly, the third protrusion can have a barb urging against a forth protrusion protruding beyond the third opening.

Certainly, the outer unit can have two opposite bottom edges respectively slidable along two side walls of a socket body.

Certainly, the adapter structure can be fixed on the socket body by a fixing device to form a network socket.

Preferably the fixing device includes a first and a second protrusions to fix the adapter structure on the socket body having a first and a second openings thereon.

Preferably the fixing device includes a strip urging the inner unit against the outer unit and a shelf urging the socket body against the adapter structure.

Certainly, the first protrusion can include a first portion inserted into the first opening and a second portion perpendicular to the strip of the fixing device.

Certainly, the second protrusion can include a first segment inserted into the second opening and a second segment laterally extended from the shelf of the fixing device.

Preferably the second opening of the socket body has an extended opening for inserting therein the second segment of the second protrusion.

According to the present invention, a method for assembling an adapter structure for providing an interface between an external wire and a circuit board, comprising the following steps of a) providing an inner unit, b) providing an outer unit separable from the inner unit, and c) mounting a first set of terminals between the inner unit and the outer unit, wherein the first terminals respectively include feet for being electrically connected with the circuit board.

Certainly the first set of terminals can be a portion of a terminal-band and simultaneously separable from the terminal-band by bending thereagainst.

Certainly the circuit board can be soldered with the terminals for connecting the adapter structure with the circuit board.

Preferably the present method further comprising a step of mounting a second set of terminals between the inner unit and the outer unit, wherein the second terminals respectively include feet for being electrically connected with the circuit board.

Preferably the first and second sets of terminals are respectively mounted at two opposite sides of the inner unit.

The present invention may best be understood through the following descriptions with reference to the accompanying drawings, in which:

DETAILED DESCRIPTION OF THE PREFERRED EMBODIMENTS

Figure 1:
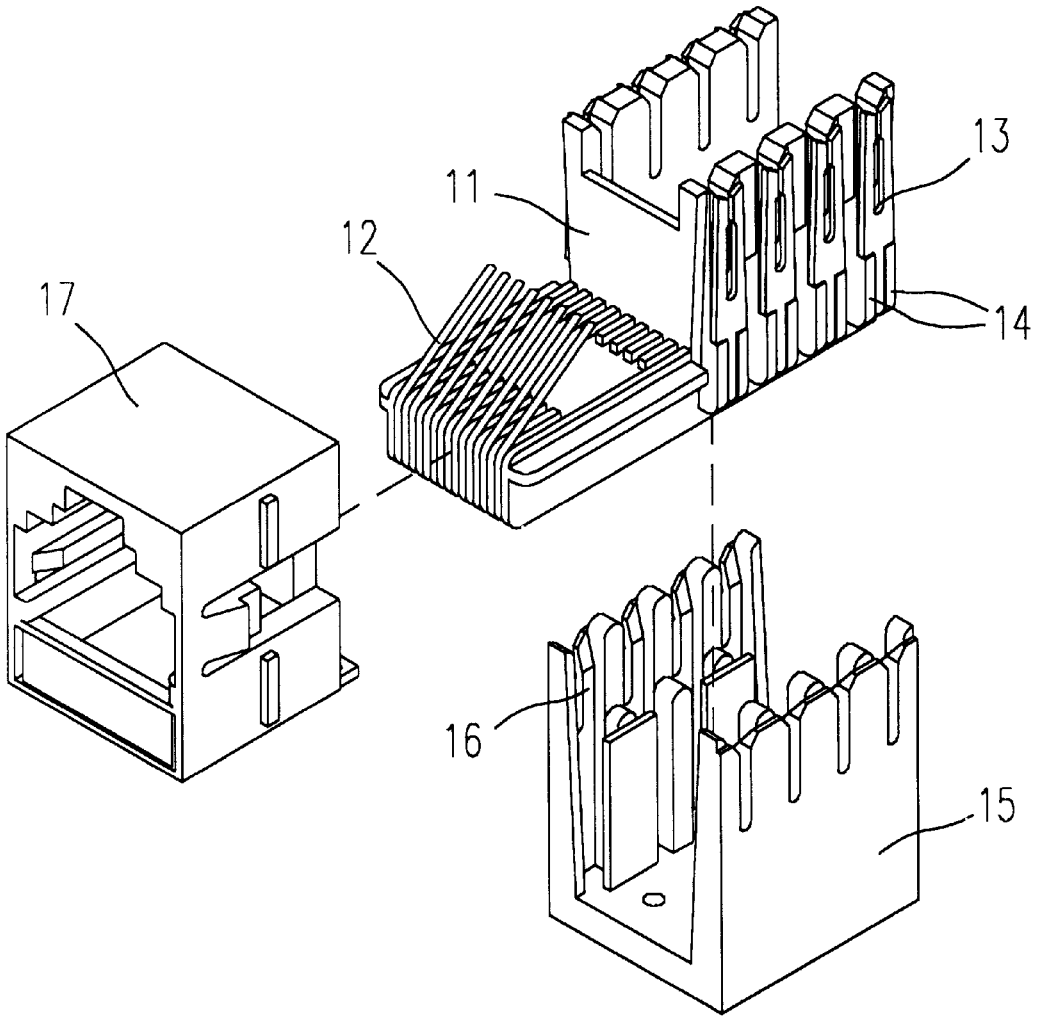
Fig. 1(PRIOR ART)
FIG. 1 is a dismantled perspective view of a prior network socket.
Figure 2:
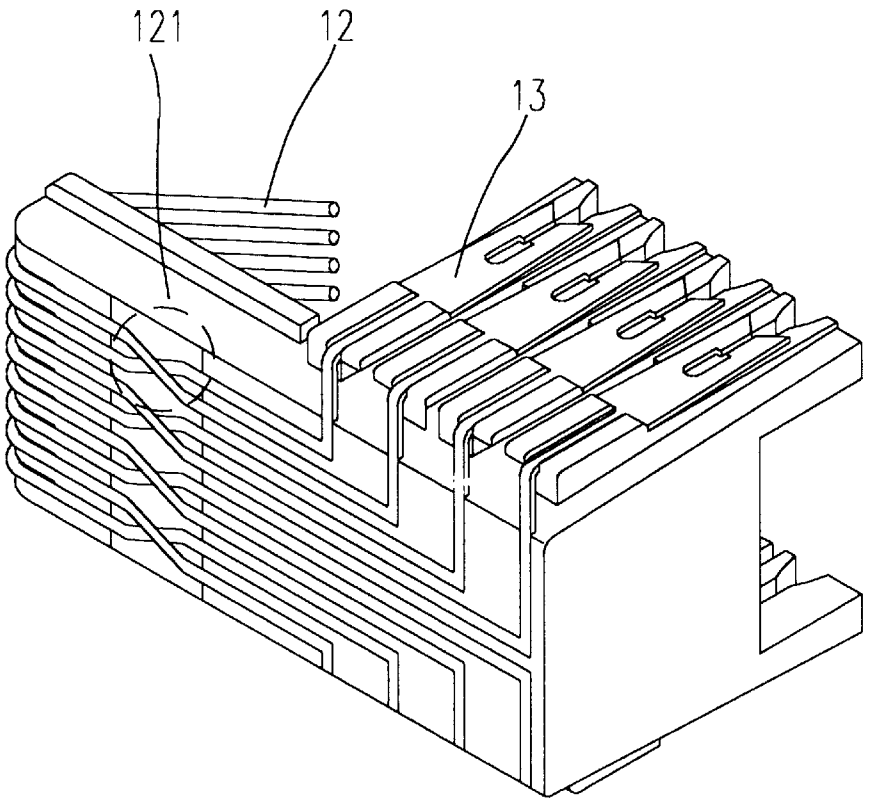
Fig. 2(PRIOR ART)
FIG. 2 is a bottom end view of an inner unit in FIG. 1.
Figure 3:
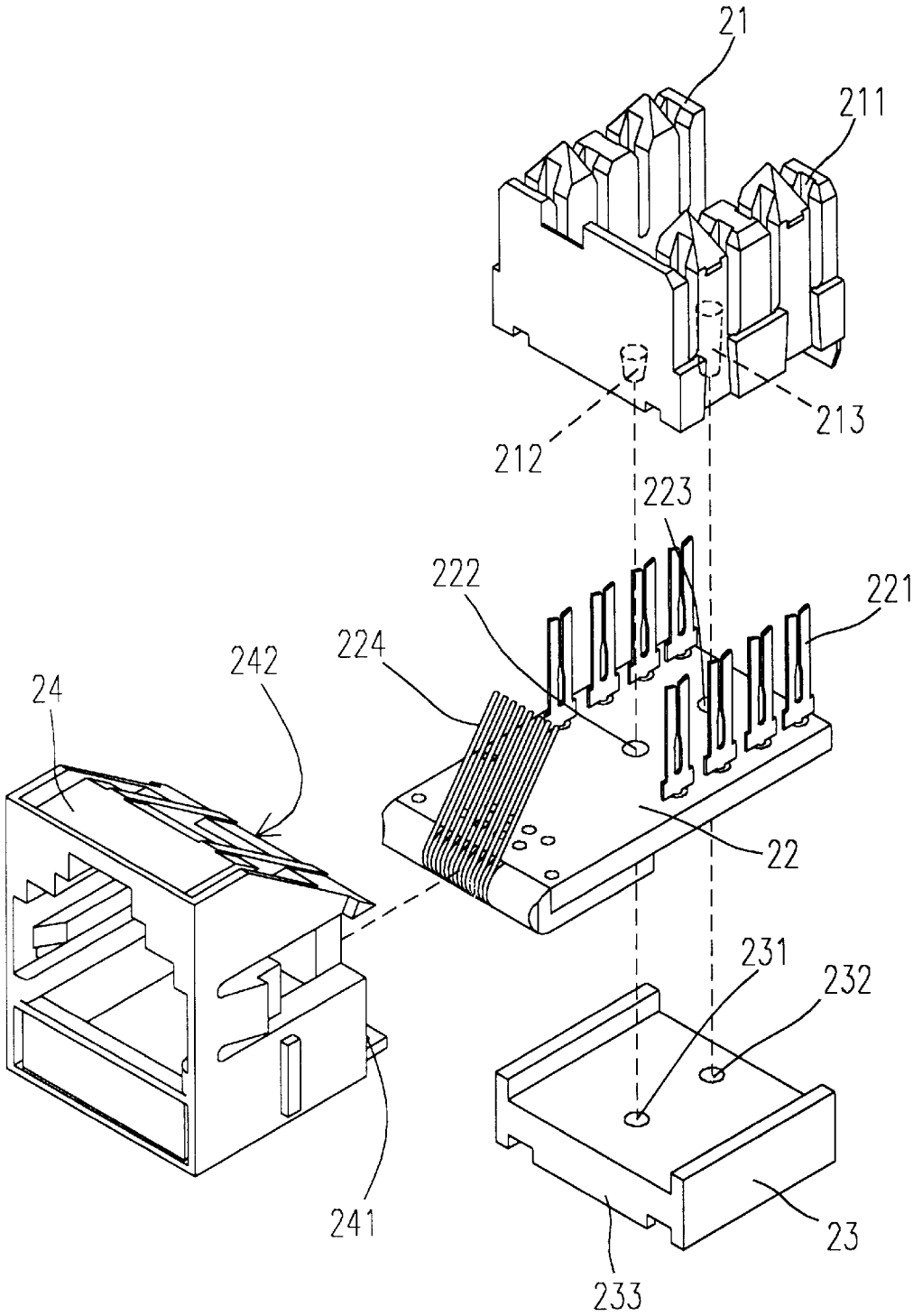
Fig. 3(PRIOR ART)
FIG. 3 is a dismantled perspective view of an other prior network socket.
Figure 4:
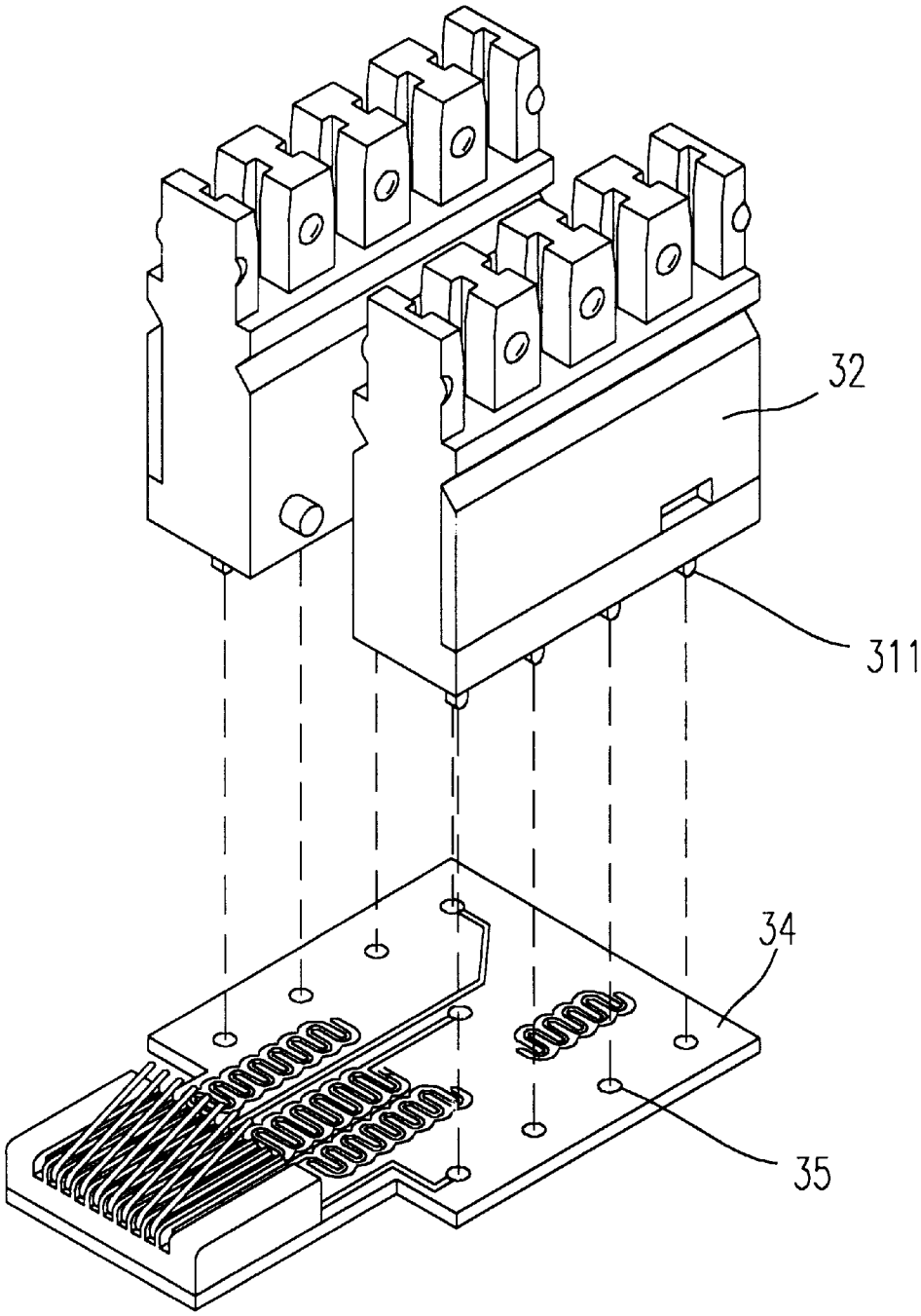
Fig. 4(PRIOR ART)
FIG. 4 is a perspective view of the adapter structure having two IDCs and one circuit board of another prior network socket.
Figure 5:
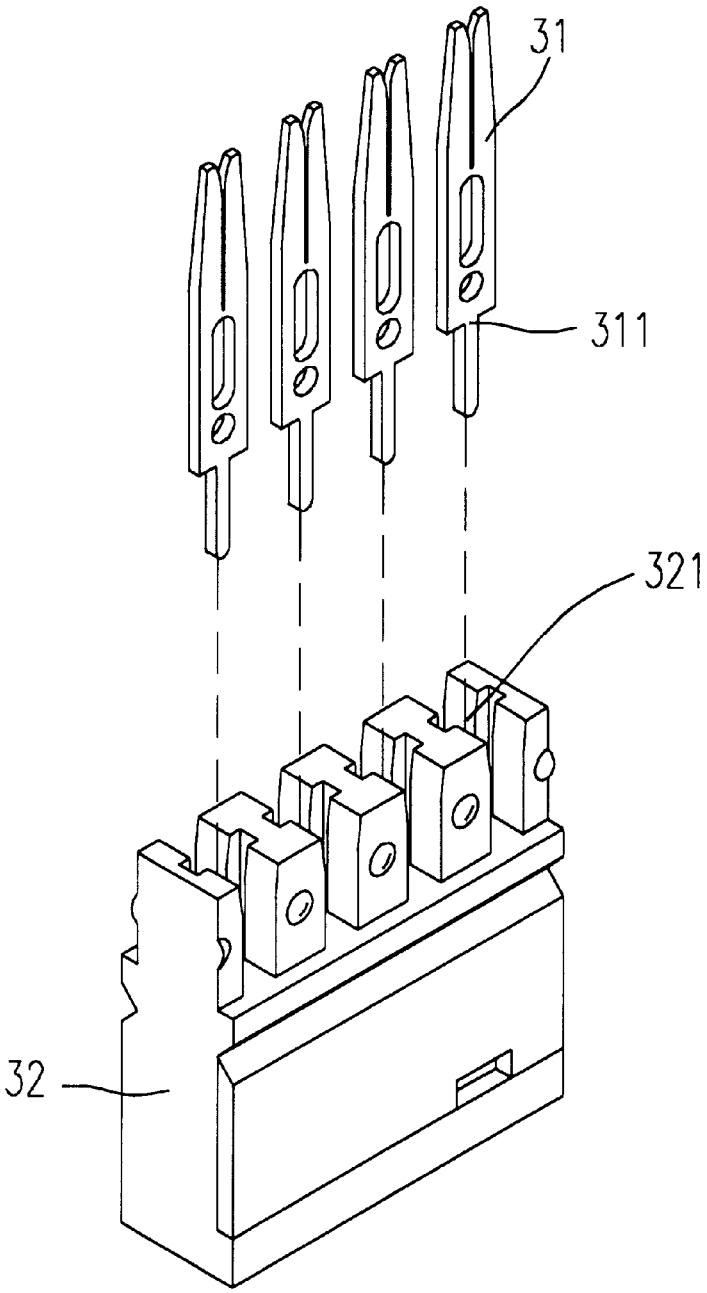
Fig. 5(PRIOR ART)
FIG. 5 is an exploded perspective view of the adapter in FIG. 4.
Figure 6:
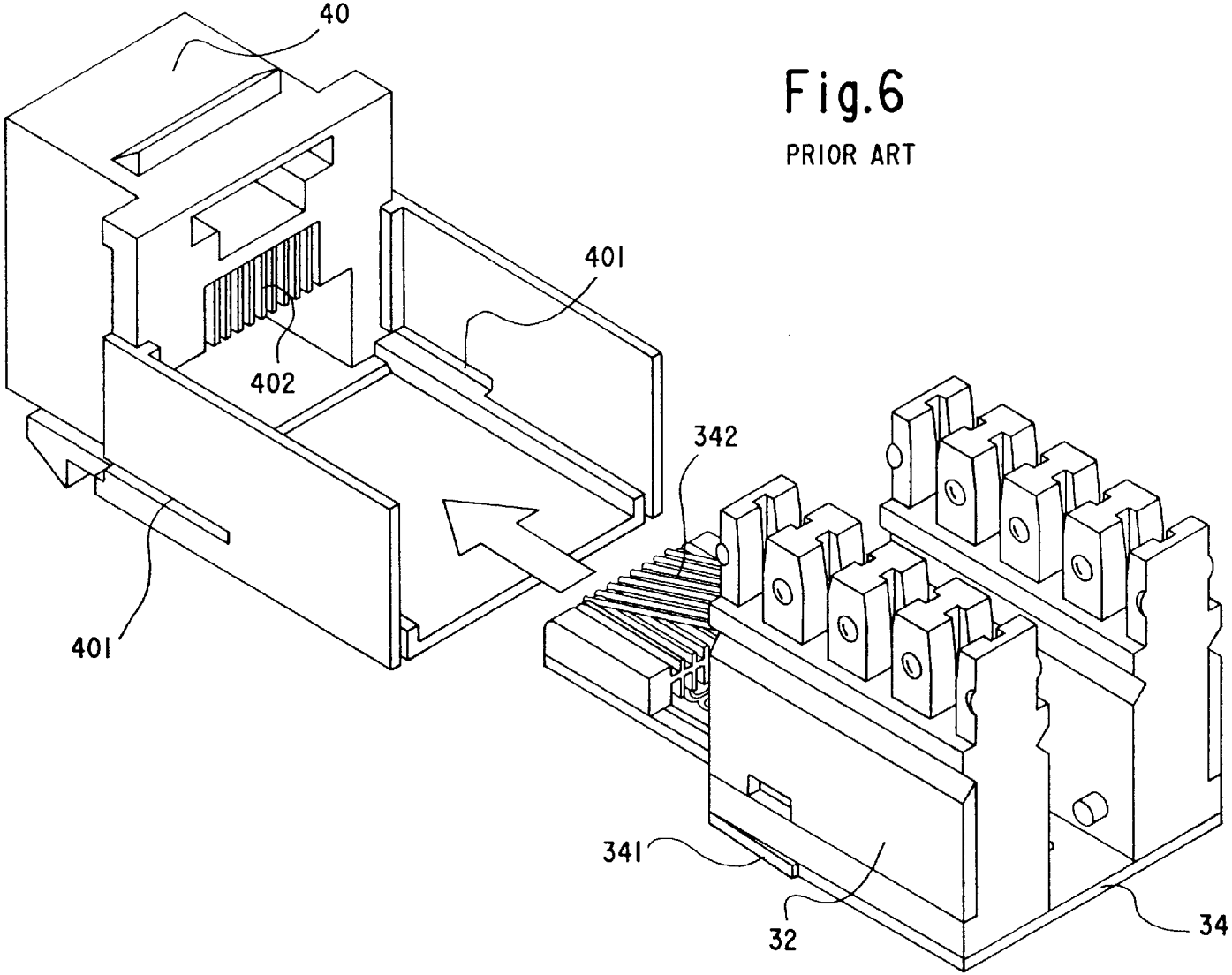
Fig.6 PRIOR ART
FIG. 6 is a perspective view of the adapter structure in FIG. 4 with a socket body before assembled.
Figure 7:
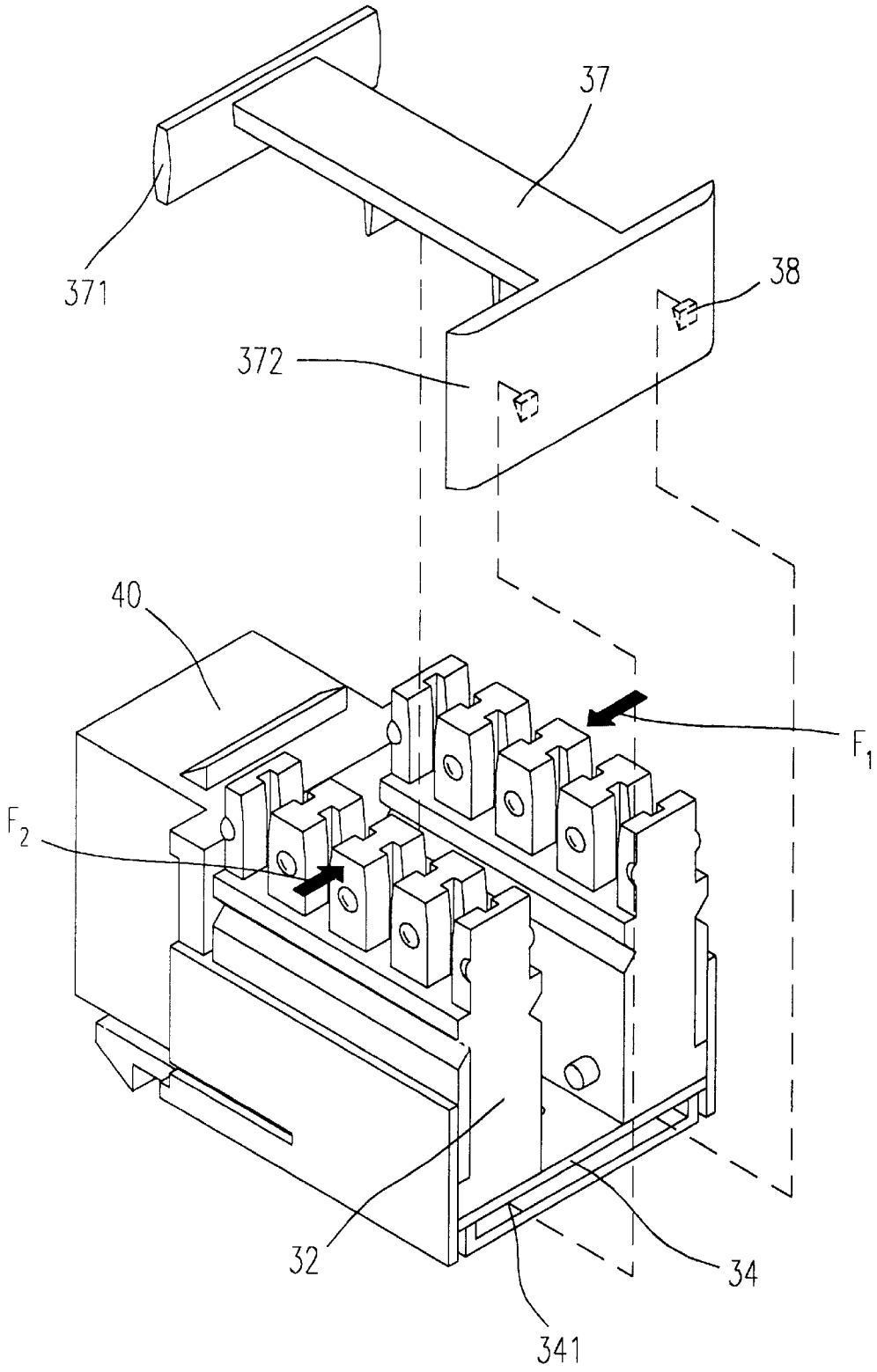
Fig. 7(PRIOR ART)
FIG. 7 is a perspective view of the socket body in FIG. 6 with a fixing device before assembled.
Figure 8:
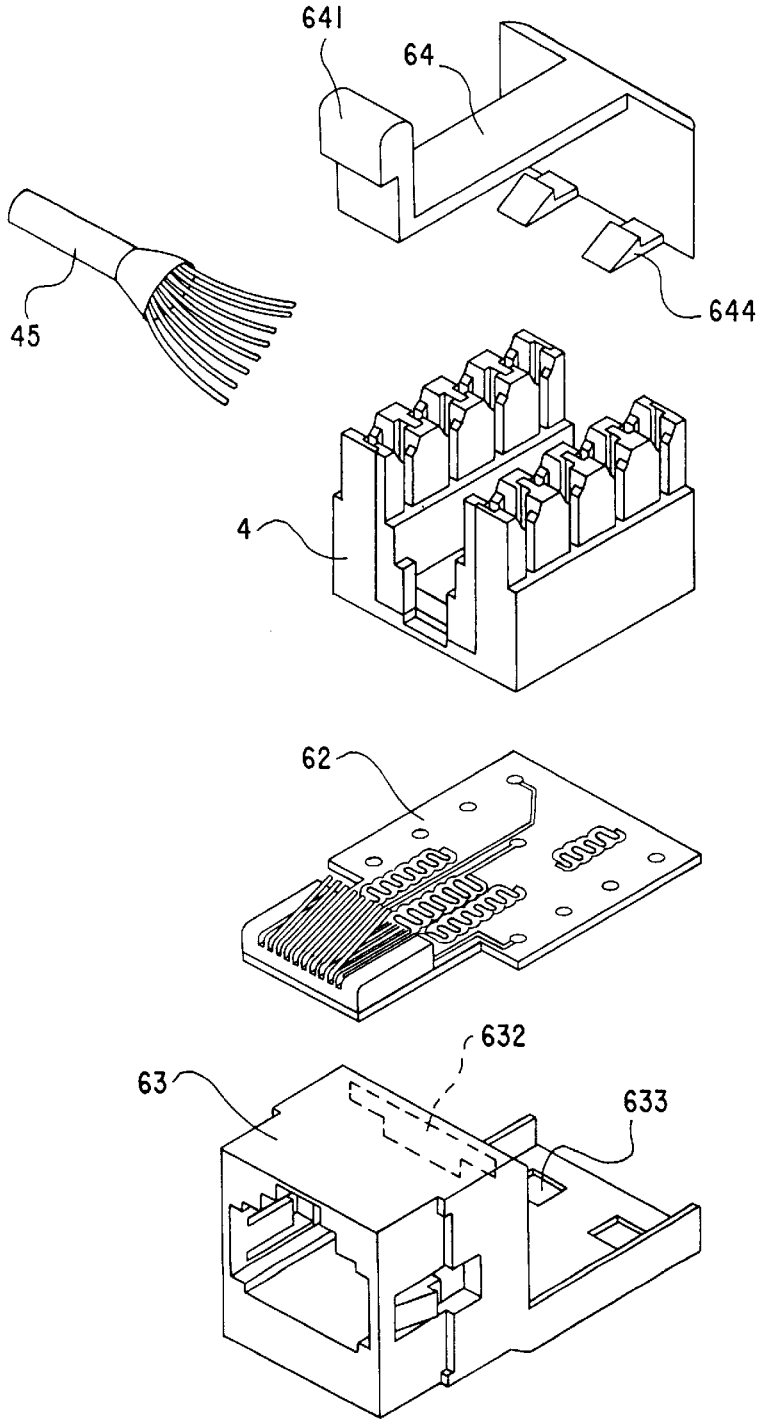
FIG. 8 is an exploded perspective view of a preferred embodiment of a network socket according to the present invention.
Figure 9:
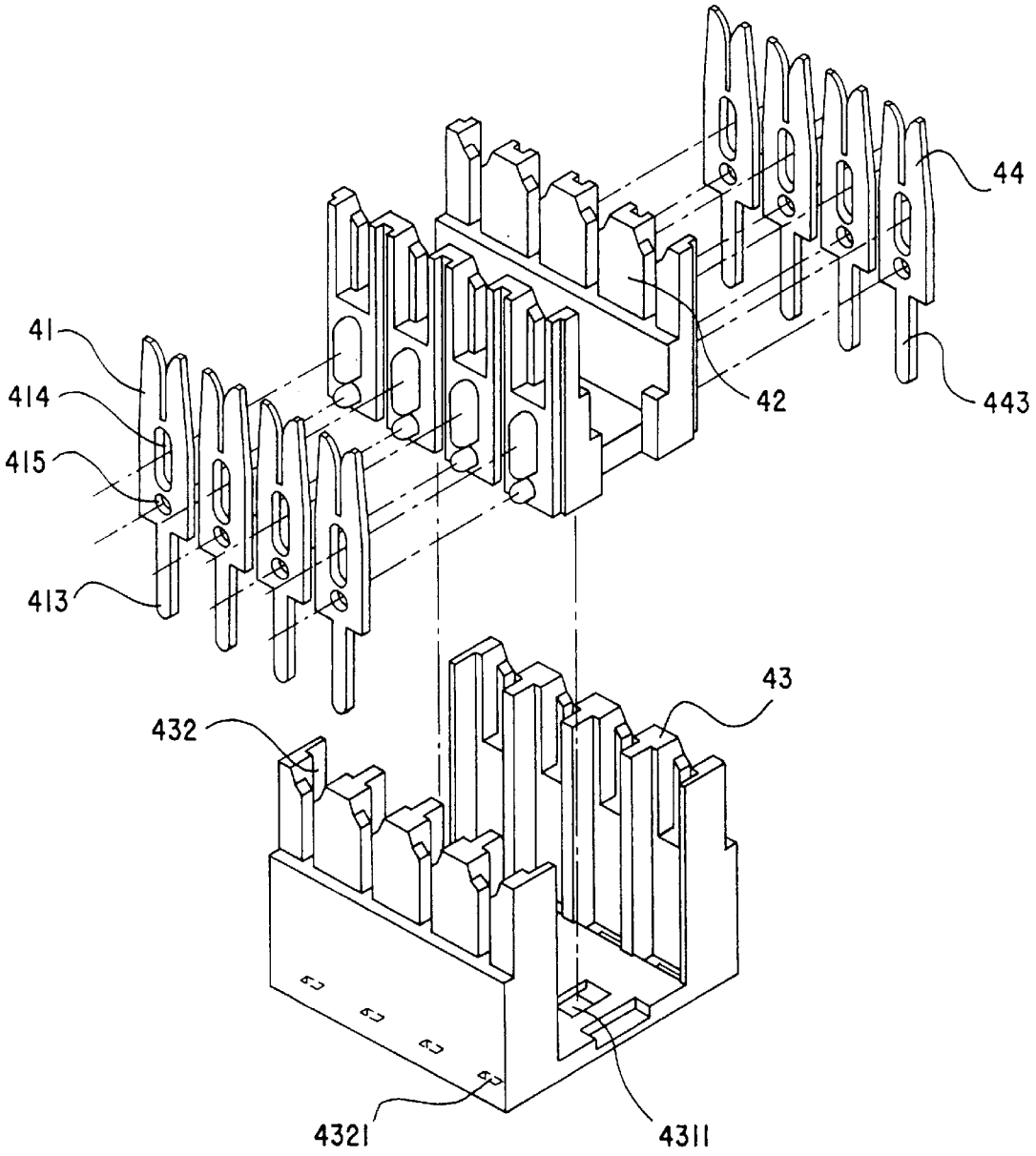
FIG. 9 is a exploded perspective view of the adapter structure in FIG. 8.

Referring to FIGS. 8 & 9, there are shown a preferred embodiment of an adapter structure 4 in accordance with the present invention. It provides an interface between an external wire 45 and a circuit board 62, and includes an inner unit 42, an outer unit 43 separable from inner unit 42, and a first set of terminals 41 mounted between inner unit 42 and outer unit 43, wherein terminals 41 respectively include feet 413 for being electrically connected with circuit board 62. It is necessary to make two metal strands in a wavy manner and get them close to each other to form coupled stands 21 in accordance with the code of Category 6 of high frequency transmission in FIG. 8.

And adapter structure 4 further includes a second set of terminals 44 mounted between inner unit 42 and outer unit 43 in FIG. 9, wherein second terminals 44 respectively include feet 443 for being electrically connected with circuit board 62. The first and second sets of terminals 41, 44 are respectively mounted at two opposite sides of inner unit 42. In FIG. 9, outer unit 43 has a first set of holes 4321 respectively penetrated by feet of terminals 413 for connection of first set of terminals 41 and circuit board 62 in FIG. 8. Adapter structure 4 is fixed on socket body 63 by a fixing device 64 to form a network socket in FIG. 9.

Figure 10:
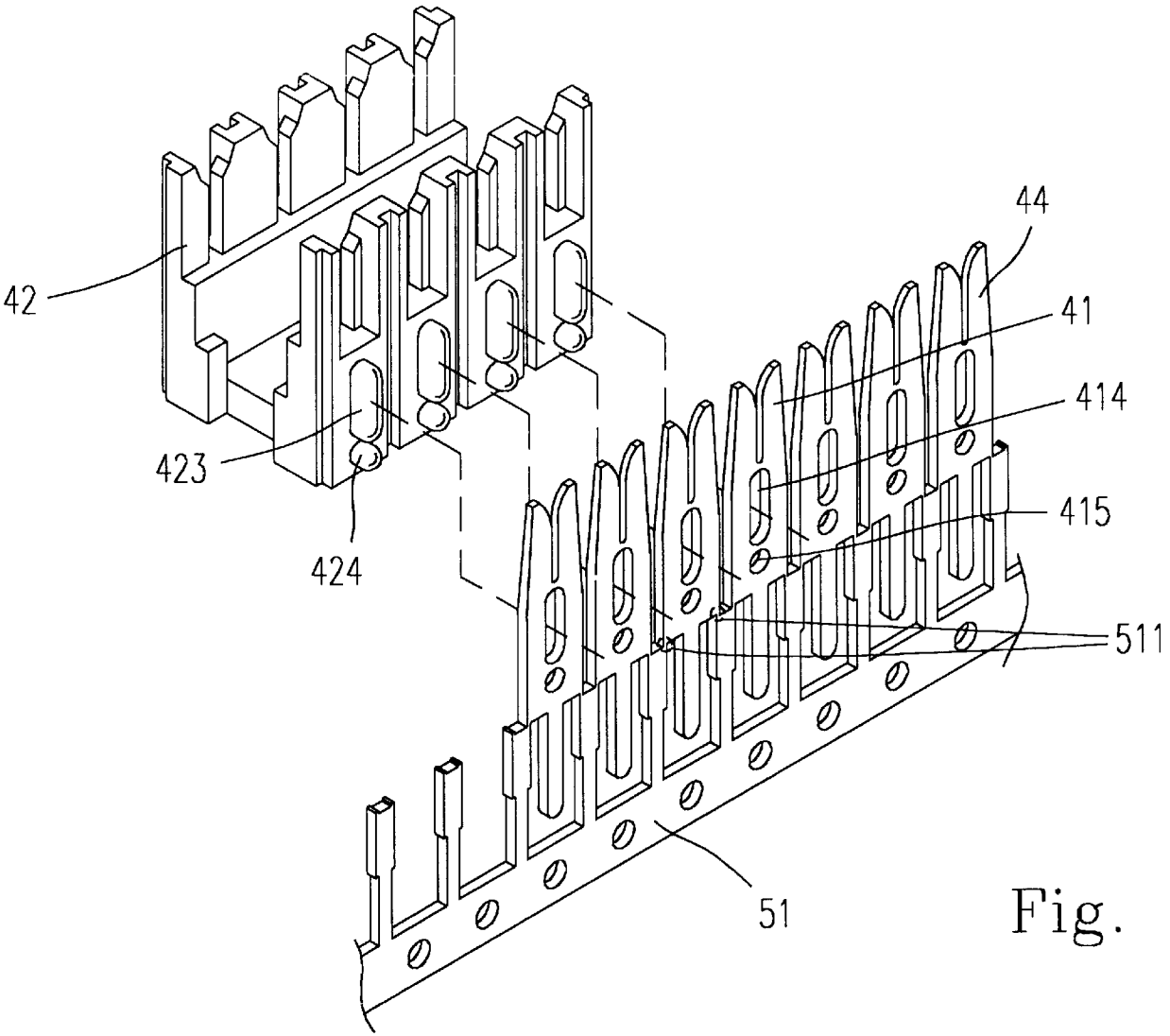
FIG. 10 is a perspective view showing the inner unit with a first and a second sets of terminals in FIG. 9 before assembled.
Figure 11:
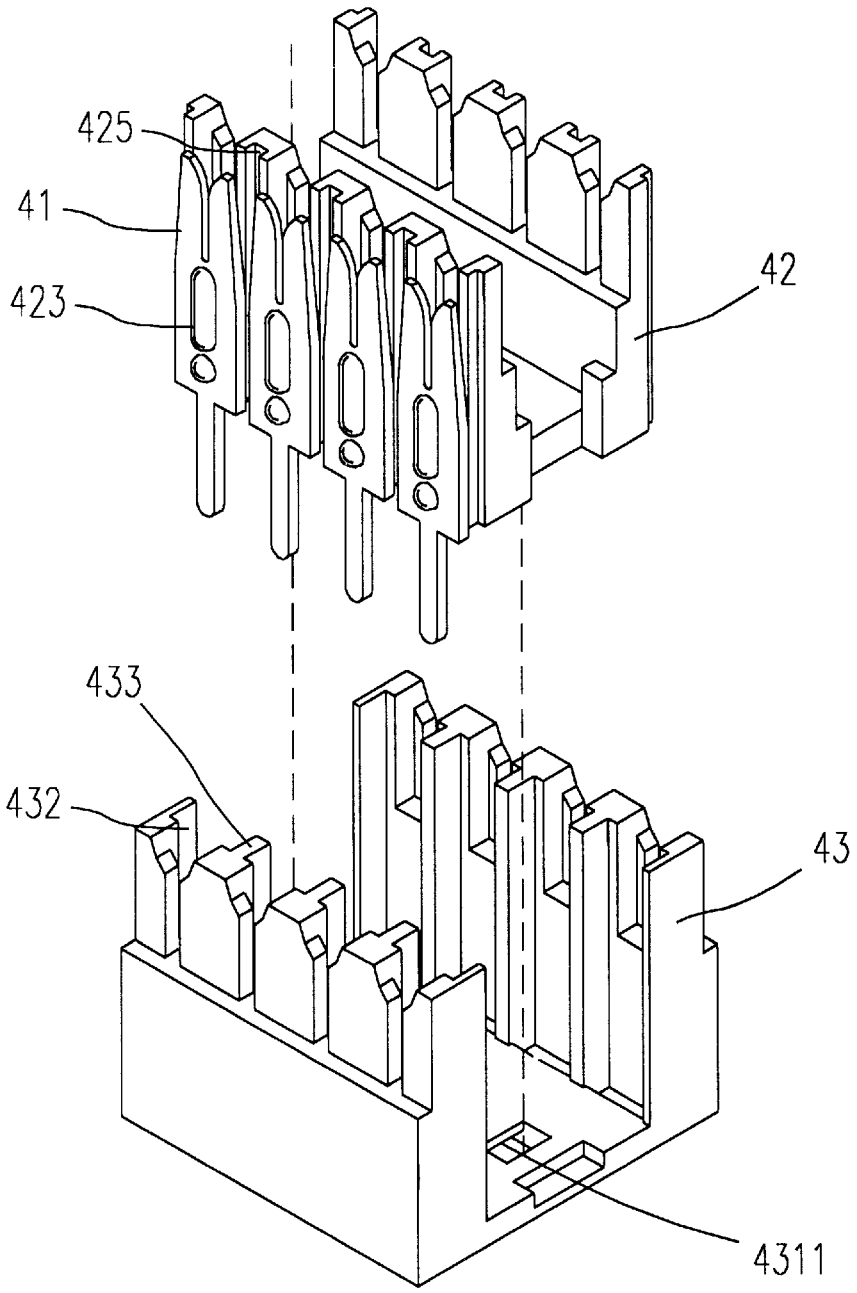
FIG. 11 is a perspective view showing the inner unit engaged with terminals in FIG. 9.
Figure 12:
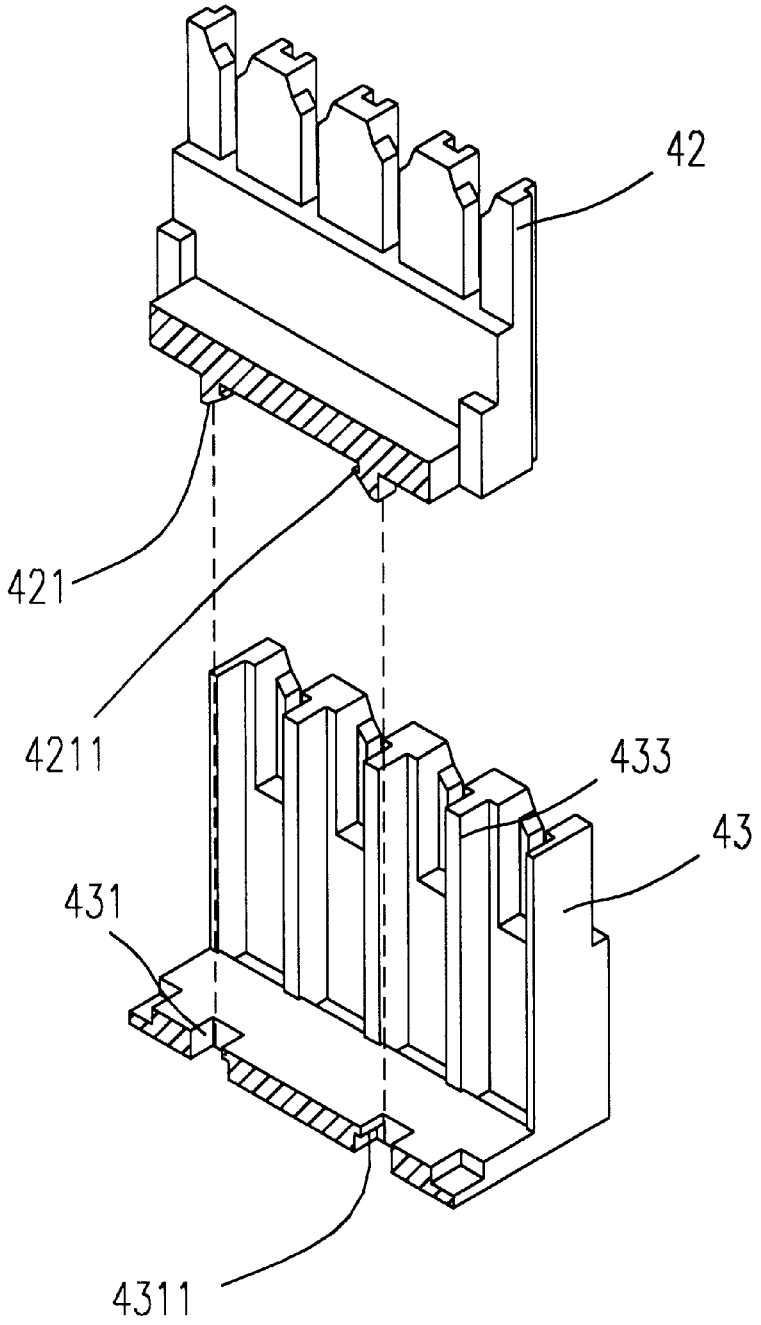
FIG. 12 is a crosssectional view showing the adapter structure in FIG. 11.

Attention is now directed to FIGS. 10 & 11 showing how adapter structure 4 (in FIG. 8) is assembled. Inner unit 42 and outer unit 43 form a mounting to receive terminals 41, 44 therein. It includes plural positioning elements 423 respectively having plural protrusions 423 and plural grains 424 for positioning the first and second sets of terminals 41, 44 respectively having plural slots 414 and plural holes 415 thereon. Outer unit 43 can have a first set of grooves 432 respectively receiving threrein the first set of terminals 41 and inner unit 42 has a first set of grooves 425 respectively receiving threrein a first set of rails 433 of outer unit 43. And inner unit 42 includes two third protrusions 421 to fix outer unit 43 having two third openings 431 thereon. It is easy to find that there are two third protrusions 421 and openings 431 in FIG. 12. In addition, third protrusions 421 respectively have two barbs 4211 urging against two fourth protrusion 4311 protruding beyond third opening 431.

Figure 13:
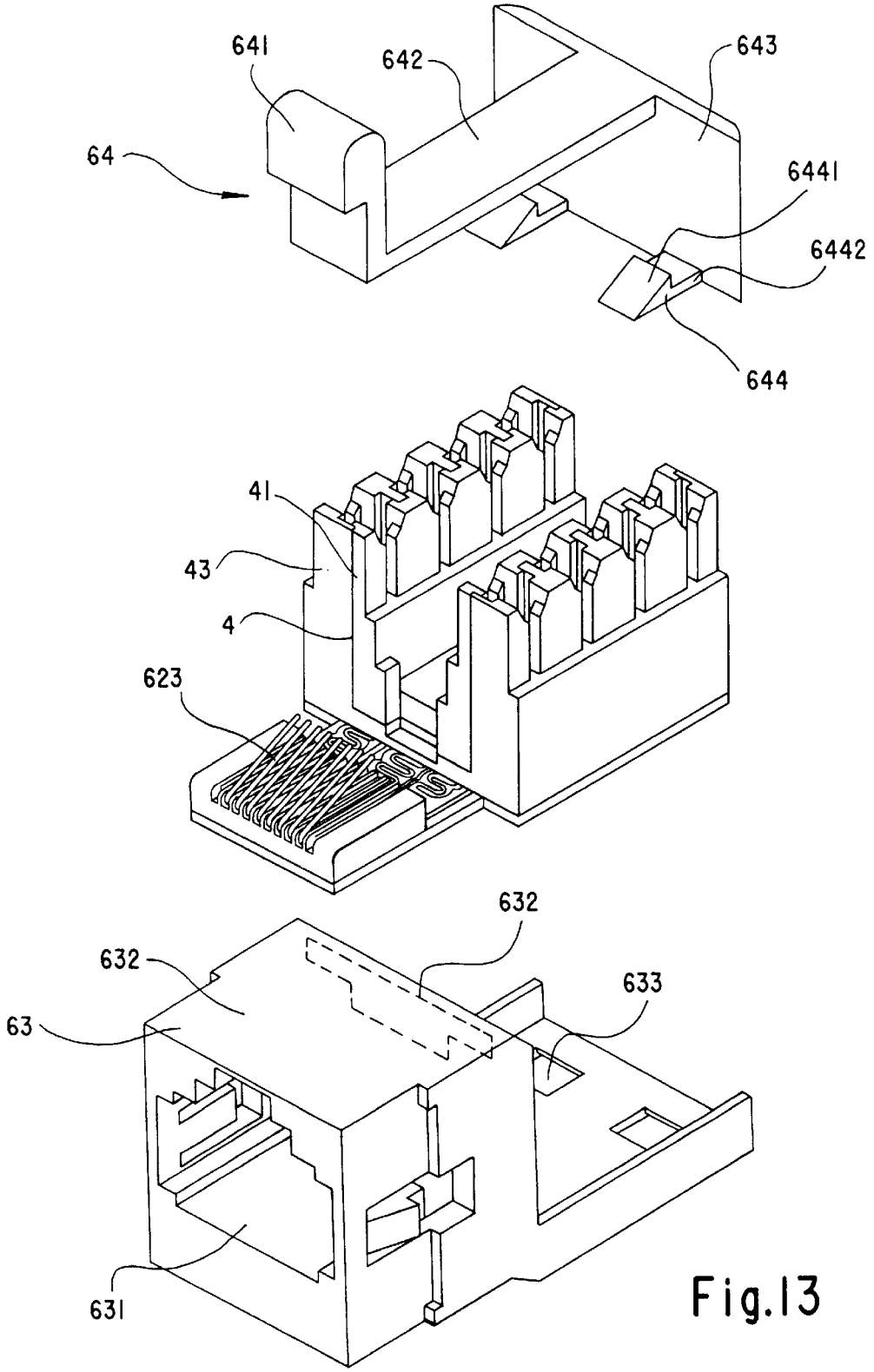
FIG. 13 is an exploded perspective view of the network socket having a fixing device.
Figure 14:
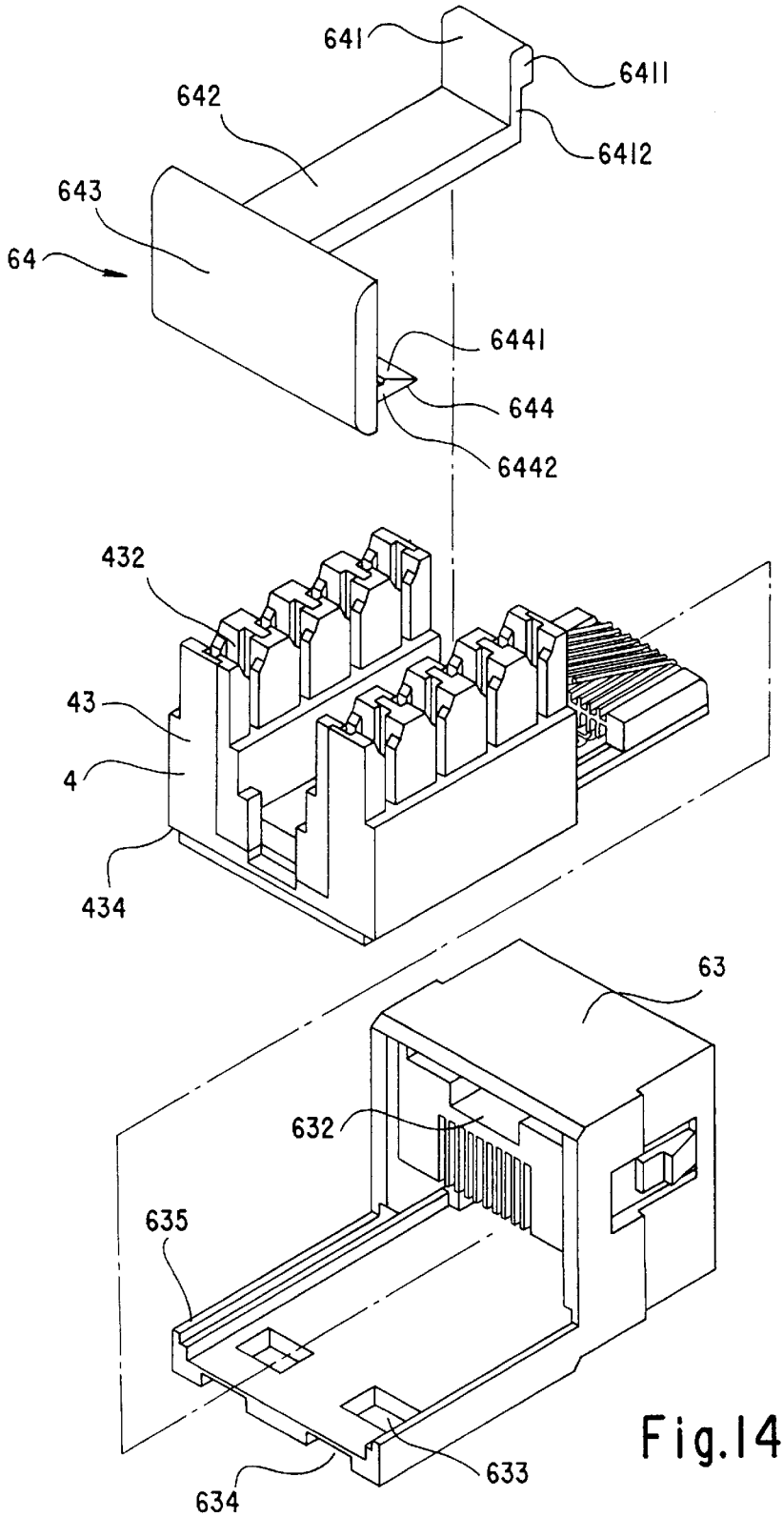
FIG. 14 is another exploded perspective view of the network socket in FIG. 13.

Referring now to FIGS. 13 & 14, there is shown fixing device 64 includes a first and two second protrusions 641, 644 to fix adapter structure 4 on socket body 63 having a first and two second openings 632, 633 thereon. And outer unit 43 has two opposite bottom edges 434 respectively slidable along two side walls 635 of a socket body 63 in FIG. 14. Fixing device 64 includes a strip 642 urging inner unit 42 against outer unit 43 and a shelf 643 urging socket body 63 against adapter structure 4. In FIG. 14, first protrusion 641 includes a first portion 6411 inserted into first opening 632 and a second portion 6412 perpendicular to strip 642 of fixing device 64. Two second protrusions 644 includes two first segments 6441 (as shown in FIG. 13) inserted into two second openings 633 and two second segments 6442 laterally extended from shelf 643 of fixing device 64. In FIG. 14, second openings 633 of socket body 63 have two extended openings 634 for inserting therein second segments 6442 of second protrusions 644.

As shown in FIGS. 8 & 9, it can be known that a method for assembling an adapter structure 4 providing an interface between an external wire 45 and a circuit board 62, includes the following steps of a) providing an inner unit 42, b) providing an outer unit 43 separable from inner unit 42, and c) mounting a first set of terminals 41 between inner unit 42 and outer unit 43, wherein first terminals 41 respectively include feet 413 for being electrically connected with circuit board 62.

Figure 15:
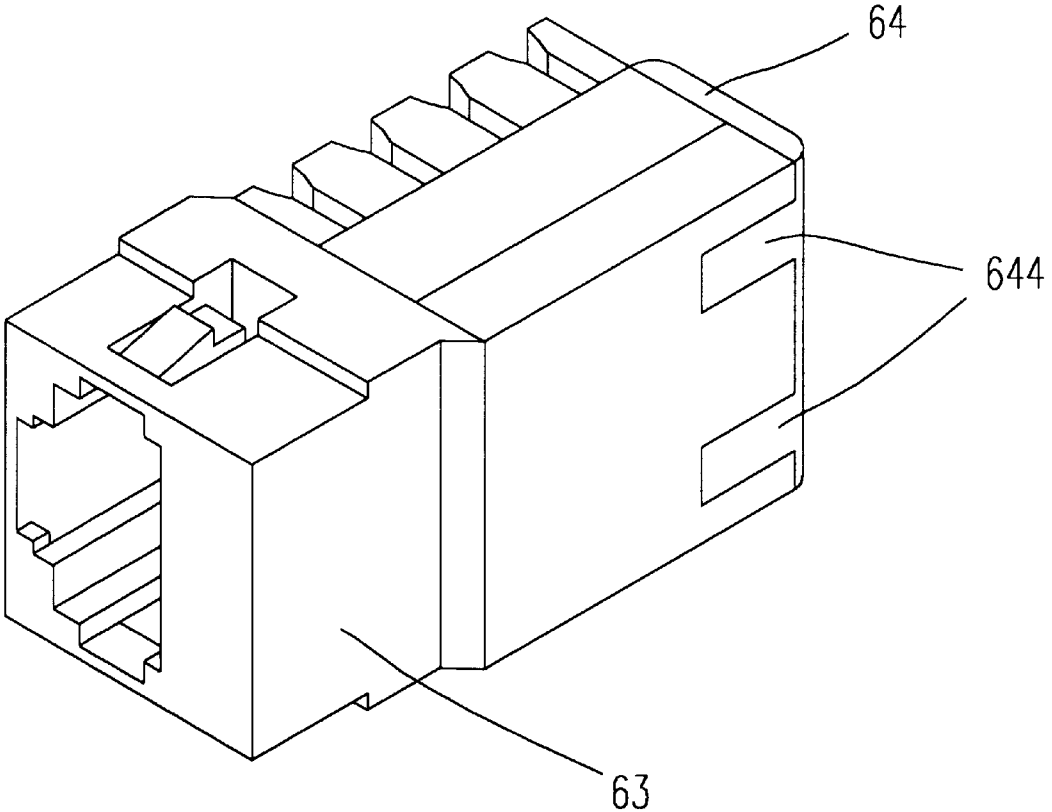
FIG. 15 is a bottom end view of the network socket in FIG. 13.

Certainly the first set of terminals 41 can be a portion 41 of a terminal-band 51 and simultaneously separable from terminal-band 51 by bending thereagainst 511. Circuit board 62 can be soldered with terminals 41 for connecting adapter structure 4 with circuit board 62. The present method further includes a step of mounting a second set of terminals 44 between inner unit 42 and outer unit 43, wherein second terminals 44 respectively include feet 443 for being electrically connected with circuit board 62. The first and second sets of terminals 41, 44 are respectively mounted at two opposite sides of inner unit 42 in FIG. 9. And socket body 63 is engaged with two second protrusions 644 of fixing device 64 in FIG. 15.

Fruthermore, adapter structure 4 could be a connector of two external wires (not shown). And the circuit on circuit board 62 can meet the network code formulated by EIA/TIA (Eletronic Industries Association/Telecommunications Industries Association).

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What I claim is:

1. An adapter structure for providing an interface between an external wire and a circuit board, comprising:

an inner unit having a bottom portion and a parallel set of protrusion elements extend from said bottom portion;

an outer unit having a bottom portion for mounting on said circuit board and a parallel set of protrusion elements extend from said outer unit bottom portion, said outer unit being separable from said inner unit, wherein said inner unit is positionable between said outer unit protrusion elements such that said inner and outer unit protrusion elements extend in a common direction; and a first set of terminals mounted between said inner unit protrusion elements and said outer unit protrusion elements, wherein said terminals respectively include feet for being electrically connected with said circuit board.

2. A structure according to claim 1 wherein said outer unit has a first set of grooves respectively receiving threrein said first set of terminals and said inner unit has a first set of grooves respectively receiving threrein a first set of rails of said outer unit.

3. A structure according to claim 1 wherein said outer unit has a first set of holes respectively penetrated by said feet of said terminals for connection of said first set of terminals and said circuit board.

4. A structure according to claim 1, further comprising a second set of terminals mounted between said inner unit and said outer unit, wherein said second terminals respectively include feet for being electrically connected with said circuit board.

5. A structure according to claim 4 wherein said first and second sets of terminals are respectively mounted at two opposite sides of said inner unit.

6. A structure according to claim 4 wherein said inner unit and said outer unit form a mounting and each of said positioning elements respectively have a plural protrusion and a plural grain for positioning said first and said second sets of terminals respectively having plural slots and plural holes thereon.

7. A structure according to claim 1 wherein said inner unit includes a third protrusion to fix said outer unit having a third opening thereon.

8. A structure according to claim 7 wherein said third protrusion has a barb urging against a fourth protrusion protruding beyond said third opening.

9. A structure according to claim 1 wherein said outer unit has two opposite bottom edges respectively slidable along two side walls of a socket body.

10. A structure according to claim 9 wherein said adapter structure is fixed on said socket body by a fixing device to form a network socket.

11. A structure according to claim 10 wherein said fixing device includes a first and a second protrusions to fix said adapter structure on said socket body having a first and a second openings thereon.

12. A structure according to claim 11 wherein said fixing device includes a strip urging said inner unit against said outer unit and a shelf urging said socket body against said adapter structure.

13. A structure according to claim 12 wherein said first protrusion includes a first portion inserted into said first opening and a second portion perpendicular to said strip of said fixing device.

14. A structure according to claim 12 wherein said second protrusion includes a first segment inserted into said second opening and a second segment laterally extended from said shelf of said fixing device.

15. A structure according to claim 14 wherein said second opening of said socket body has an extended opening for inserting therein said second segment of said second protrusion.

16. A method for assembling an adapter structure for providing an interface between an external wire and a circuit board, comprising the following steps of:

a) providing an inner unit having a bottom portion and a parallel set of protrusion elements extend from said bottom portion;

b) providing an outer unit having a bottom portion for mounting on said circuit board and a parallel set of protrusion elements extend from said outer unit bottom portion such that said outer unit is separable from said inner unit;

c) positioning said inner unit between said outer unit protrusion elements such that said inner and outer unit protrusion elements extend in a common direction; and d) mounting a first set of terminals between said inner unit protrusion elements and said outer unit protrusion elements, wherein said first set of terminals respectively include feet for being electrically connected with said circuit board.

17. A method according to claim 16 wherein said first set of terminals is a portion of a terminal-band and simultaneously separable from said terminal-band by bending thereagainst.

18. A method according to claim 16 wherein said circuit board is soldered with said terminals for connecting said adapter structure with said circuit board.

19. A method according to claim 16, further comprising a step of mounting a second set of terminals between said inner unit and said outer unit, wherein said second terminals respectively include feet for being electrically connected with said circuit board.

20. A method according to claim 19 wherein said first and second sets of terminals are respectively mounted at two opposite sides of said inner unit.

21. An adapter structure to be received in a socket body for providing an interface between an external wire and a circuit board, comprising:

an inner unit;

an outer unit separable from said inner unit;

a first set of terminals mounted between said inner unit and said outer unit, wherein said terminals respectively include feet for being electrically connected with said circuit board; and a fixing device including first and second protrusions to fix said adapter structure on said socket body having first and second openings thereon to form a network socket, said fixing device also including a strip urging said inner unit against said outer unit and a shelf urging said socket body against said adapter structure.

22. The adapter structure according to claim 21, wherein said outer unit has opposite bottom edges respectively slidable along two side walls of said socket body.

23. The adapter structure according to claim 21, wherein said first protrusion includes a first portion inserted into said first opening and a second portion perpendicular to said strip of said fixing device.

24. The adapter structure according to claim 21, wherein said second protrusion includes a first segment inserted into said second opening and a second segment laterally extended from said shelf of said fixing device.

25. The adapter structure according to claim 24, wherein said second opening of said socket body has an extended opening for inserting therein said second segment of said second protrusion.

* * * * *